US007160579B2

(12) United States Patent
Gugler et al.

(10) Patent No.: US 7,160,579 B2
(45) Date of Patent: Jan. 9, 2007

(54) METHOD AND DEVICE FOR COATING A MOVING WEB

(75) Inventors: Gilbert Gugler, Marly (CH); Maurice Pasquier, La Tour-de Trême (CH)

(73) Assignee: Ilford Imaging Switzerland GmbH (CH)

( * ) Notice: Subject to any disclaimer, the term of this patent is extended or adjusted under 35 U.S.C. 154(b) by 0 days.

(21) Appl. No.: 10/660,399

(22) Filed: Sep. 10, 2003

(65) Prior Publication Data

US 2004/0047999 A1 Mar. 11, 2004

(30) Foreign Application Priority Data

Sep. 10, 2002 (EP) ..... 02405783

(51) Int. Cl.
*B05D 1/30* (2006.01)
*B05C 5/00* (2006.01)

(52) U.S. Cl. ..... 427/420; 118/324; 118/DIG. 4

(58) Field of Classification Search ..... 427/420; 118/DIG. 4, 324
See application file for complete search history.

(56) References Cited

U.S. PATENT DOCUMENTS

| | | | | |
|---|---|---|---|---|
| 4,879,968 | A | 11/1989 | Denz et al. | |
| 6,048,582 | A | 4/2000 | Schweizer et al. | |
| 6,454,858 | B1 * | 9/2002 | Oki et al. | 118/410 |
| 2005/0126479 | A1 * | 6/2005 | Metzger et al. | 118/326 |

FOREIGN PATENT DOCUMENTS

| | | | |
|---|---|---|---|
| DE | 101 17 668 | A1 * | 10/2002 |
| EP | 0 281 520 | A2 | 2/1988 |
| EP | 0 327 020 | A2 | 1/1989 |
| EP | 0 606 038 | A1 | 12/1993 |
| EP | 0 740 197 | A1 | 4/1995 |
| EP | 0 841 588 | A2 | 4/1995 |
| EP | 0 907 103 | A1 | 10/1997 |
| EP | 1 023 949 | A1 | 1/2000 |
| EP | 1 023 949 | A1 * | 8/2000 |
| JP | 55-073365 | | 11/1978 |
| JP | 2000-218209 | | 1/2000 |
| WO | 03/049870 | A1 * | 6/2003 |

* cited by examiner

*Primary Examiner*—Katherine Bareford
(74) *Attorney, Agent, or Firm*—Onofrio Law; Dara L. Onofrio, Esq.

(57) ABSTRACT

A method for curtain coating a moving web (8) is described, wherein the total amount of the coating liquids and of the lateral flow liquid, added perpendicular to the lateral extension of the curtain (6), is deposited on the moving web (8) under formation of only a minimally thickened bead, wherein there is no need to separate the lateral flow liquid before impingement on the moving web. The corresponding device incorporates in the edge guides (7) a groove (13) having incorporated, in its surface, channels parallel to the direction of the falling curtain (6). The curtain is stabilized with the lateral flow liquid which is supplied to the groove (13), the real guide surface of the curtain, perpendicular to the lateral extension of the curtain (6).

13 Claims, 3 Drawing Sheets

METHOD AND DEVICE FOR COATING A MOVING WEB

FIELD OF THE INVENTION

The present invention relates to a method and a device for coating a moving web, wherein a coating solution is applied to the moving web in a free falling curtain.

BACKGROUND OF THE INVENTION

Particularly in the case of large widths of the coating machine and at high speeds, the method of curtain coating shows a great number of problems with respect to the uniform application of the coating liquids present in the free falling curtain to the moving web.

There is the problem that the edges of the free falling curtain need to be stabilized, because otherwise the curtain would contract towards the center under the influence of surface tension forces. Lateral guides are normally used in order to obtain a stable curtain that has the same thickness over the whole coating width. Different types of such lateral guides have been described for example in patent applications EP 0,281,520, EP 0,606,038, EP 0,740,197, EP 0,841,588, EP 0,907,103 and EP 1,023,949. A supplementary liquid (lateral flow liquid) is supplied at the edges of the curtain in order to reduce the deceleration of the rate of fall induced by the friction of the curtain liquid at the lateral guides. The edge zones of the curtain are cut off and/or sucked off by a vacuum device before the curtain impinges on the web in order to adjust the coating width and to stabilize the border areas formed on the web by the impinging coating solutions.

All these methods forming the state of the art are based on the assumption that the lateral flow liquid added at the lateral guides has a lubricating and rinsing effect which stabilizes the free fall of the curtain. There is the further assumption that this supplementary amount of lateral flow liquid has to be separated before the curtain impinges on the moving web. All these separation devices however, in particular the suction based devices equipped with small orifices, are prone to obstruction and contamination, inducing different problems during the coating process, particularly in the case where the curtain contains coating solutions that harden quickly, are sticky or reactive and/or in the case of high coating weights.

New lateral guides are described in patent application EP 0,740,197, where the lateral flow liquid, for example water or a mixture of water and glycerol, is supplied as a film transversely to the extension of the curtain and where this liquid film flows downwards in a groove of the lateral guides. This prevents uncontrolled undulating disturbances in the curtain. There are no indications in this patent application on the width of the groove or on its surface properties best suited for the coating process.

A suction device that may be used together with these lateral guides is described in patent application EP 0,841,588, wherein the border area of the curtain is removed together with the added lateral flow liquid. Without this suction device the lateral guides described in patent application EP 0,740,197 may not be used in regular production curtain coating operations.

SUMMARY OF THE INVENTION

Accordingly, it is an object of the invention to provide a method and a device for curtain coating, where the free fall of the curtain is not disturbed, the coating solutions are uniformly applied to the web without formation of a bead and where it is not necessary to remove the border area of the curtain using a separation device.

This object is achieved by choosing an optimal width for the groove in the lateral guides, an optimized structure of the surface of the groove and a suitable shape of the lower ends of the lateral guides.

A further object of the invention is to provide a method and a device for coating without a significant loss of material, where a good homogeneity, especially of the border area, of the coating is achieved under a multitude of coating conditions (speed of the moving web, coating weight, viscosity and dynamic surface tension of the coating solutions).

Other objects, features and advantages of the present invention will be apparent when the detailed description of the preferred embodiment of the invention are considered with reference to the drawings which should be construed in an illustrative and not limiting sense as follows:

DETAILED DESCRIPTION OF THE INVENTION

The invention is explained in more detail in the following drawings and examples.

Figure 1:
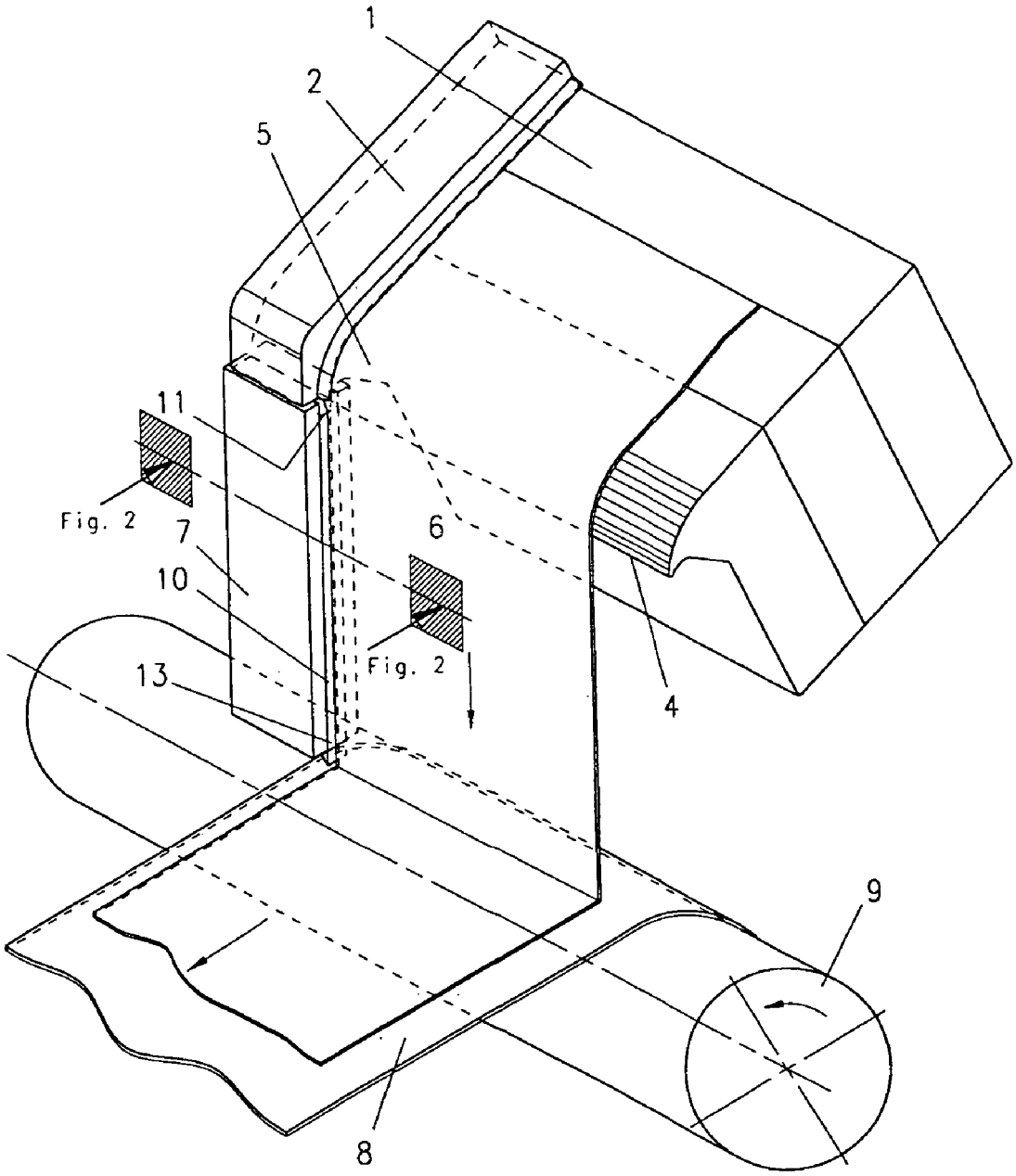
FIG. 1 shows a schematic perspective view of a curtain coating installation.

As indicated schematically in FIG. 1, the most important parts of the coating device are the pouring plates (1) with the laterally mounted lateral limiter plates (2). The free fall of the curtain (6) begins at lip (4) of the pouring front plate (5). From this point, the curtain (6) is stabilized by the lateral guides (7). The coating device further comprises a web (8), which is guided around the pouring roll (9) in the indicated rotational direction and underneath the coating device in order to be coated.

Figure 2:
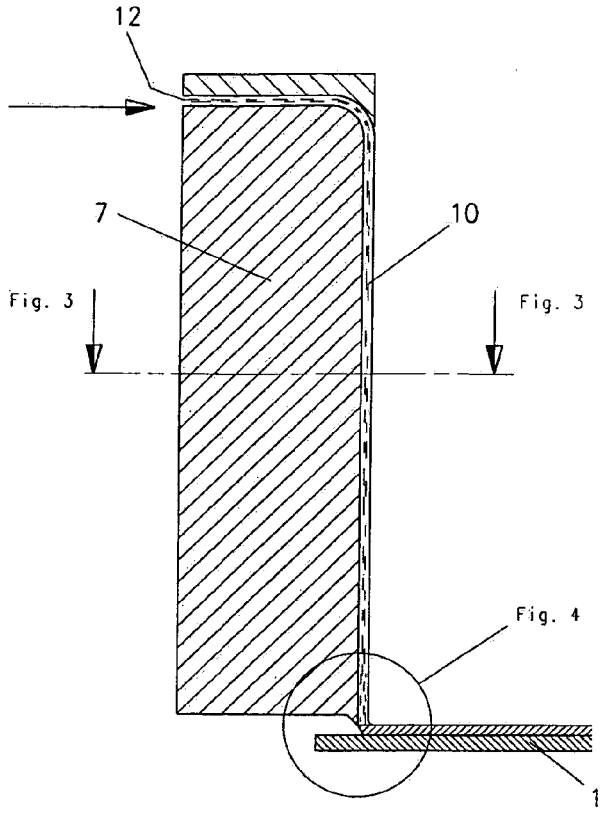
FIG. 2 shows a longitudinal section at the indicated place of FIG. 1. The sectional plane corresponds to the surface of the falling curtain.

In the coating device according to the invention, the laterally limiting liquid film (11) is supplied transversally to the curtain, as shown in FIG. 2. The supplying slit (12) has such a shape that the flow direction of the liquid film (11 ) at the exit of the slit is the same as for the falling curtain (6) in order to minimize disturbances of the speed profile of the falling curtain.

The lateral flow liquid consists mainly of water, eventually containing surfactants, inorganic or organic salts, polymers, pigments or ingredients of the coating solutions. It is also possible to use non-aqueous liquids as lateral flow liquid.

Figure 3:
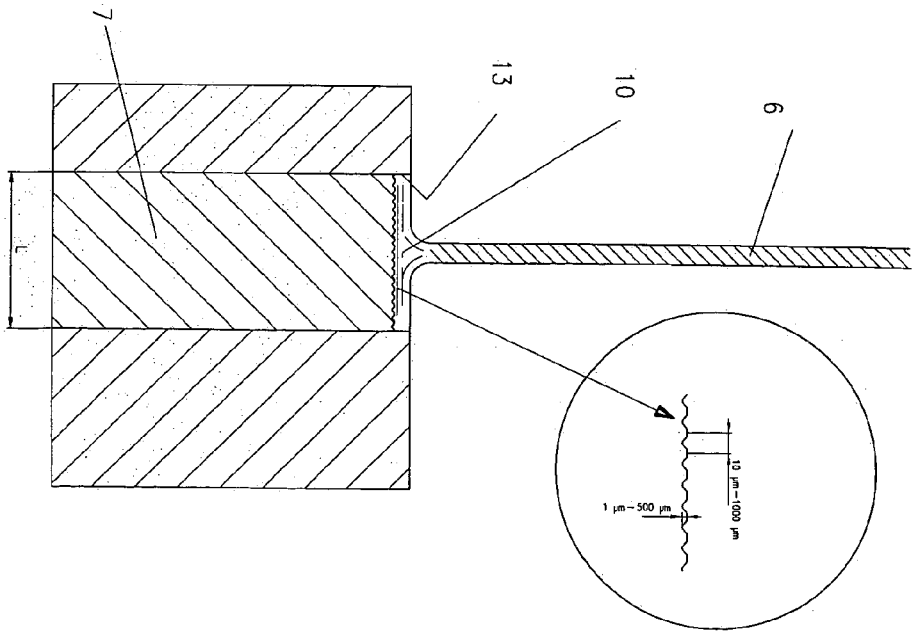
FIG. 3 shows a longitudinal section at the indicated place of FIG. 2.

The width L of the groove (13) in FIG. 3, the real guide surface of the curtain, is from 4 mm to 15 mm, preferably from 6 mm to 8 mm. Within this range of widths of the groove (13), an optimal stability of the curtain is obtained with very small quantities of lateral flow liquid as measured by the amount of the coating solutions minimally necessary for curtain formation and where the curtain just does not detach from the lateral guides.

The physical properties of the surface of the groove (13) are of utmost importance. Rough surfaces are preferred, in particular surfaces with incorporated channels in the flow direction of the curtain. The channels may be of sinusoidal, triangular or rectangular profile or a mixture of these profiles, independent of the fact that such rough surfaces are considerably more difficult to clean than smooth surfaces. The incorporated channels are arranged in the direction of the falling curtain, either continuously or discontinuously. The distance between the channels is from 10 μm to 1000 μm, in particular from 100 μm to 250 μm. The depth of the channels is from 1 μm to 500 μm, in particular from 30 μm to 100 μm.

A stable coating process is possible with amounts of the lateral flow liquid lower than 3 l/h with this device according to the invention.

In contrast all devices known up to now, as for example the combination of the lateral guides described in patent application EP 0'740'197 with the suction device described in patent application EP 0'841'588, need high amounts of lateral flow liquid, typically from 8 l/h to 24 l/h.

The device according to the invention and the method according to the invention unexpectedly need considerably lower amounts of lateral flow liquid using the same coating solutions, due to the optimized surface structure and width of the groove compared to the same device and method without the optimized surface structure and width of the groove. The stability of the border area of the curtain near the lateral guides has been considerably improved by this optimized width and surface structure of the groove. There is therefore no longer a need to remove the border areas of the curtain by a separation device during the coating process.

Figure 4:
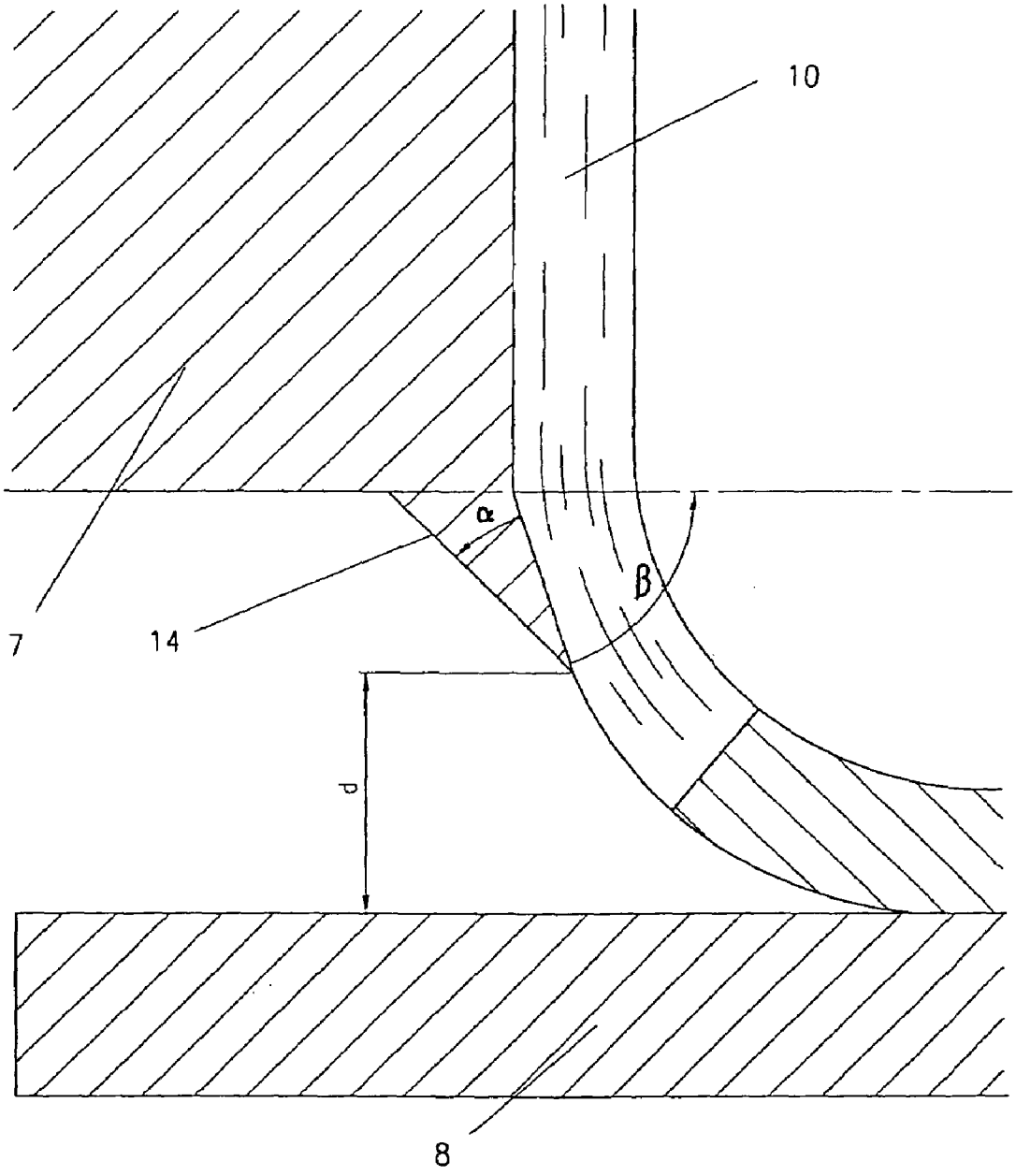
FIG. 4 shows in a longitudinal section a detailed view of the lower end of an edge guide at the indicated place of FIG. 2.

At the lower ends (14) of the lateral guides (7), the whole amount of the coating solutions and of the lateral flow liquid are deposited on the moving web (8), as is illustrated in FIG. 4. In order to prevent the separation of the curtain from the lateral guides, the angle α between the two sides of the protruding edge needs to be between 0° and 90°, in particular between 10° and 60°.

The added, mainly aqueous lateral flow liquid at the lateral guides leads to a more or less pronounced dilution of the border areas of the curtain resulting in local reductions of the viscosity of the coating solutions and higher coating weights in the border areas. Furthermore air may be entrapped below the falling curtain, inducing further coating defects.

In order to prevent this air entrapping, in particular with low coating weights and low viscosities of the coating solutions, the lower ends of the laterals guides need to be of optimal shape. The lower ends (14) of the lateral guides (7), directed towards the curtain, have the shape of a downward protruding edge, as illustrated in FIG. 4. This edge may be sharply defined or slightly rounded. The size of the height and of the width of this edge is in the region of some millimeters. The angle β between the horizontal line and the side of the protruding edge facing the curtain is from 0° to 90°, in particular from 30° to 90°.

At the lowest ends of the lateral guides, the falling curtain separates from the lateral guides and falls unguided onto the moving web below the lateral guides. In this unguided region, the curtain shows the tendency to contract due to the surface tension forces of the coating solutions. This leads to a more or less pronounced bead at the border of the coating with all the devices known up to now in the curtain coating process. Such beads have to be prevented, because the higher amounts of coating solutions in these regions do not dry sufficiently fast, which may lead to sticking of the different loops on the wound rolls.

In order to minimize the size of the formed beads, the distance d between the protruding edge at the lower ends (14) of the lateral guides (7) and the moving web (8) to be coated needs to be from 0.05 mm to 3 mm, in particular from 0.4 mm to 1.5 mm, as shown in FIG. 4.

Liquids in the border region of the curtain (a mixture of lateral flow liquid and coating solutions) may be drawn below the elements of the lateral guides, depending on the coating weights and viscosities of the coating solutions, leading to strong soiling in the region of curtain impingement. In order to prevent this soiling, the distance d has to be adapted to the coating weights and viscosities of the coating solutions. The surfaces of the undersides of the lower ends (14) of the lateral guides (7) need to be hydrophobic. The free surface energy of these undersides has to be in the range of 10 mNm to 60 mNm, in particular in the range of 20 mNm to 45 mNm. Suitable surface coatings of the underside consist of amorphous carbon or TEFLON (polytetrafluoroethylene). A particularly preferred surface coating is TEFLON (polytetrafluouroethylene).

It is to be understood that the device according to the invention may be varied with respect to the indicated dimensions and adapted to a wide variety of coating conditions occurring during coating processes. While each measure individually allows considerable improvements with respect to coating quality, the combination of the improvements described above for the lateral guides (suitable angles a and β, optimal surface structure and width of the groove and a suitable surface coating of the undersides of the lower ends) gives a method and a device, where separation and suction devices are no longer needed and where the quality of the coating on the moving web is nevertheless impeccable.

The device according to the invention shows the following considerable advantages:

There is no need for a costly infrastructure for separation and drainage systems for the separated coating solutions.

There are less coating interruptions caused by obstruction of sucking devices, because these trouble prone devices are no longer necessary.

It is possible to coat highly reactive coating solutions.

The device according to the invention will be compared with a device representing the state of the art in the following examples. However, it has to be understood that the present invention will not be restricted or limited in any way by these specific examples.

EXAMPLES

Example 1

A first coating solution containing the ingredients of Table 1 was prepared. The quantities, with the exception of water, are those of the coated and subsequently dried layer.

TABLE 1

| Ingredient (Concentration) | Quantity (g/m$^2$) |
|---|---|
| Lanthanum-doped AlOOH (solid powder) | 48.000 |
| Lactic acid (90%) | 0.780 |
| Polyvinyl alcohol A (10.0%) | 1.440 |

TABLE 1-continued

| Ingredient (Concentration) | Quantity (g/m$^2$) |
|---|---|
| Polyvinyl alcohol B (7.5%) | 2.880 |
| Plasticizer 1 (40%) | 1.440 |
| Plasticizer 2 (50%) | 0.200 |
| Surfactant (3%) | 0.208 |
| Water | 153.752 |
| Total | 208.700 |

The Lanthanum-doped AIOOH was prepared according to the method described in patent application EP 0'967'086, example 1. Polyvinyl alcohol A is Mowiol 26–88, polyvinyl alcohol B is Mowiol 56–98, both available from Omya A G, Oftringen, Switzerland; plasticizer 1 is 1,1,1-tris-(hydroxymethyl)-propane, available from Fluka-Chemie, Buchs, Switzerland; plasticizer 2 is glycerol; the surfactant is Triton X-100, available from Christ Chemie AG, Reinach, Switzerland.

A second coating solution containing the ingredients of Table 2 was prepared. The quantities, with the exception of water, are those of the coated and subsequently dried layer.

TABLE 2

| Ingredient (Concentration) | Quantity (g/m$^2$) |
|---|---|
| Gelatine | 11.700 |
| Bactericide (5.88%) | 0.006 |
| Surfactant B (10.3%) | 0.051 |
| Surfactant B C (5.26%) | 0.071 |
| Water | 60.172 |
| Total | 72.000 |

The gelatin is a limed bone gelatin, available from Deutsche Gelatinefabriken, Eberbach, Germany; the Bactericide is 4-chloro-m-cresol, available from Chemia Brugg A G, Brugg, Switzerland; surfactant B is Niaproof 04, available from Fluka Chemie GmbH, Buchs, Switzerland and surfactant C is Olin 10G, available from Arch Chemicals, Norwalk, USA.

A curtain was formed with these two coating solutions using the curtain coating device incorporating the lateral guides according to the invention. The stability of the curtain was evaluated by determining the minimal quantities of the coating solutions that were necessary for the formation of a stable curtain between the lateral guides according to the invention. Water with a small addition of sodium chloride was used as lateral flow liquid. The addition of sodium chloride is necessary in order to allow the adjustment of the flow rates by magneto flows.

Results obtained with the device according to the invention are presented in Table 3. The width of the groove (13) was 7 mm, the angle α was 45°, the angle β was 90°, surface structure of the groove consisted of continuous channels of serrate profile with a depth of 50 μm at a distance of 150 μm of each other.

TABLE 3

| Quantity of added lateral flow liquid (l/h) | Minimal quantity of coating solution 1 (l/h) | Minimal quantity of coating solution 2 (l/h) |
|---|---|---|
| 1 | 63.18 | 43.74 |
| 1.5 | 38.88 | 25.26 |

TABLE 3-continued

| Quantity of added lateral flow liquid (l/h) | Minimal quantity of coating solution 1 (l/h) | Minimal quantity of coating solution 2 (l/h) |
|---|---|---|
| 2 | 43.74 | 20.40 |
| 3 | 68.04 | 34.02 |

Results obtained with the device described in patent application EP 0'841'588 are presented in Table 4. In this case, the width of the groove (13) was 17 mm, the angle α was 45°, the angle β was 90° and the groove had a smooth surface.

TABLE 4

| Quantity of added lateral flow liquid (l/h) | Minimal quantity of coating solution 1 (l/h) | Minimal quantity of coating solution 2 (l/h) |
|---|---|---|
| 6 | 72.90 | 43.74 |
| 8 | 53.46 | 37.92 |
| 16 | 63.18 | 58.32 |

A comparison of the results in Tables 3 and 4 immediately shows that the minimal quantities of the two coating solutions necessary for the formation of a stable curtain are considerably lower with the device according to the invention compared to the device forming the state of the art. The needed quantity of lateral flow liquid is also much lower.

Example 2

The coating solution described in Table 1 was used.

The prepared coating solution was applied to a commercially available polyethylene coated paper support with the aid of a curtain coating device. Water with a small addition of sodium chloride was used as lateral flow liquid. The distance d between the lower end of the lateral guides and the moving web was varied in the range between 0.4 mm and 3.0 mm. The underside of the lateral guides had a TEFLON (polytetrafluoroethylene) surface coating.

The quality of the of the border areas (beads) and of the amount of liquid entrapment (coating solution and lateral flow liquid) below the elements of the lateral guides were evaluated using the following five-grade scale:

| | |
|---|---|
| 1 (best) | regular border, width of the bead <3.5 mm |
| 2 | regular border, width of the bead from 3.5 mm to 5 mm |
| 3 | irregular border, width of the bead <5 mm |
| 4 | regular or irregular border, width of the bead >5 mm |
| 5 (worst) | regular or irregular border with separation of the curtain or air entrapment |

The results obtained for the quality of the border areas (beads) and the tendency for liquid entrapment below the lateral guides are presented in Table 5 for different distances between the lower ends of the lateral guides and the moving web to be coated.

TABLE 5

| Distance between the lower end of the lateral guides and the web (mm) | Evaluation of the border areas (beads) and of liquid entrapment below the lateral guides |
|---|---|
| 0.40 | Scale 3; entrapment of liquid below the lateral guides |
| 0.50 | Scale 3; entrapment of liquid below the lateral guides from time to time with subsequent contamination |
| 0.75 | Scale 1; no entrapment of liquid below the lateral guides |
| 1.00 | Scale 1; no entrapment of liquid below the lateral guides |
| 1.50 | Scale 2; no entrapment of liquid below the lateral guides |
| 2.00 | Scale 3; no entrapment of liquid below the lateral guides |
| 3.00 | Scale 4; no entrapment of liquid below the lateral guides |

The results of Table 5 immediately show that the optimum distance between the lower ends of the lateral guides and the moving web to be coated is between 0.4 mm and 1.5 mm.

Example 3

The coating solution described in Table 2 was used.

The prepared coating solution was applied to a commercially available polyethylene coated paper support with the aid of a curtain coating device. Water with a small addition of sodium chloride was used as lateral flow liquid. The distance d between the lower end of the lateral guides and the moving web was 1.0 mm. The surface of the underside of the lateral guides was coated with different materials.

The results obtained for the quality of the border areas (beads) and the tendency for liquid entrapment below the lateral guides are presented in Table 6 for the surface of the undersides of the lower ends of the lateral guides coated with different materials.

TABLE 6

| Surface coating of the underside of the lower ends of the lateral guides | Evaluation of liquid entrapment below the lateral guides |
|---|---|
| Stainless steel | Always entrapment of liquid below the lateral guides, approximately 5 to 10 mm, drop formation at the underside |
| Titanium nitride | Always entrapment of liquid below the lateral guides, approximately 5 to 10 mm, some drop formation at the underside |
| Amorphous carbon | Irregular entrapment of liquid below the lateral guides, approximately 3 to 8 mm, no drop formation at the underside |
| TEFLON (polytetrafluoroethylene | No entrapment of liquid below the lateral guides |

The results in Table 6 immediately show that TEFLON polytetrafluoroethylene) is an especially suitable material for the surface coating of the underside of the lower end of the lateral guides according to the invention.

Finally, variations from the examples given herein are possible in view of the above disclosure. Therefore, although the invention has been described with reference to certain preferred embodiments, it will be appreciated that other coating solutions may be devised and used in the method and device described herein, which are nevertheless within the scope and spirit of the invention as defined in the claims appended hereto.

The foregoing description of various and preferred embodiments of the present invention has been provided for purposes of illustration only, and it is understood that numerous modifications, variations and alterations may be made without departing from the scope and spirit of the invention as set forth in the following claims.

The invention claimed is:

1. Method for curtain coating a moving web (8) with at least one coating solution in a curtain (6), a lateral flow liquid (10) being supplied in a groove (13) having a width from 6 mm to 8 mm, perpendicular to the lateral extension of the curtain, on lateral guides (7) having lower ends (14) with a downward protruding edge whose side facing the curtain forms an angle β with a horizontal line facing the web and the two sides of the downwards protruding edge include an angle α, which stabilize the curtain on both sides, wherein the total amount of the coating solution and the total amount of the lateral flow liquid are coated onto the moving web (8).

2. Method for curtain coating a moving web (8) according to claim 1, wherein the lateral flow liquid (10) is not separated from the coating liquid before both impinge on the moving web (8).

3. Method for curtain coating a moving web (8) according to claim 1, wherein the distance between the protruding edge at the lower end (14) of the lateral guides (7) and the moving web (8) is from 0.05 mm to 3 mm.

4. Method for curtain coating a moving web (8) according to claim 1, wherein the distance between the lower end (14) of the lateral guides (7) and the moving web (8) is from 0.4 mm to 1.5 mm.

5. Device for curtain coating a moving web, comprising a curtain (6), two lateral guides (7) for the curtain, exit slits (12) above the lateral guides to supply a lateral flow liquid (10) perpendicular to the lateral extension of the curtain in a groove (13) on the lateral guides having incorporated channels in the flow direction of the curtain and with a lower end (14) of the lateral guides having a downward protruding edge whose side facing the curtain forms an angle β with a horizontal line facing the web and the two sides of the downwards protruding edge include an angle α, wherein the width of the groove is from 6 mm to 8 mm.

6. Device according to claim 5, wherein the angle α between the two sides of the downwards protruding edge at the lower end (14) of the edge guide (7) is from 10° to 60°.

7. Device according to claim 5, wherein the angle β between the horizontal line and the side of the protruding edge facing the curtain at the lower end (14) of the edge guide (7) is from 30° to 90°.

8. Device according to claim 5, wherein the underside of the lower end (14) of the edge guide (7) has a hydrophobic surface with a free surface energy from 10 mNm to 60 mNm.

9. Device according to claim 5, wherein the underside of the lower end (14) of the edge guide (7) has a hydrophobic surface with a free surface energy from 20 mNm to 45 mNm.

10. Device according to claim 9, wherein the surface of the underside of the lower end (14) of the lateral guide (7) is coated with polytetrafluoroethylene.

11. Device according to claim 5, wherein the incorporated channels at the surface of the groove (13) have a sinusoidal or rectangular profile or a mixture of these profiles.

12. Device according to claim 5, wherein the incorporated channels at the surface of the groove (13) have a depth from 1 μm to 500 μm.

13. Device according to claim 5, wherein the incorporated channels at the surface of the groove (13) have a depth from 30 μm to 100 μm.

* * * * *